US005109750A

United States Patent [19]

Kayaian

[11] Patent Number: 5,109,750

[45] Date of Patent: May 5, 1992

[54] CLOSED-BREECH MISSILE AND WEAPON SYSTEM

[75] Inventor: George Kayaian, 129 Cambridge Dr., Hicksville, N.Y. 11801

[73] Assignee: George Kayaian

[21] Appl. No.: 538,539

[22] Filed: Jun. 13, 1990

[51] Int. Cl.[5] ..... F41F 3/042; F41F 3/052

[52] U.S. Cl. ..... 89/1.818; 89/1.704; 89/1.806; 89/1.816

[58] Field of Search ..... 89/1.816, 1.818, 1.806, 89/1.807, 1.703, 1.704, 1.705, 1.706

[56] References Cited

U.S. PATENT DOCUMENTS

| | | | |
|---|---|---|---|
| 2,344,957 | 3/1944 | Anzalone | 89/1.816 |
| 2,966,827 | 1/1961 | Harvey | 89/1.816 |
| 3,421,410 | 1/1969 | Kayaian | 89/1.807 |
| 3,490,330 | 1/1970 | Walther | 89/1.7 |
| 3,745,876 | 7/1973 | Rocha | 89/1.7 |
| 3,990,355 | 11/1976 | Looger et al. | 89/1.816 |
| 4,227,438 | 10/1980 | Precoul | 89/1.816 |
| 4,432,269 | 2/1984 | Castagner et al. | 89/1.816 |
| 4,895,061 | 1/1990 | Baricos et al. | 89/1.818 |

*Primary Examiner*—David H. Brown

[57] ABSTRACT

A lightweight reusable closed breech weapon system 116, for infantry in antiarmor or antipersonnel applications wherein offensive or defensive postures are required. The weapon system 116 comprises a two stage missile 92 adapted to be fired from a preloaded launch tube assembly 82 and a launcher assembly 20. The initial recoil effects of firing at first being partially reduced with a plenum chamber 90, secondly by rear seal pressure relief ports 89, further reduced through a pneumatic pressure release system housed within the launcher assembly 20 and finally minimized by recoil pads 36 and 38.

3 Claims, 4 Drawing Sheets

CLOSED-BREECH MISSILE AND WEAPON SYSTEM

BACKGROUND—FIELD OF INVENTION

This invention relates to a weapon system, and more particularly a light two stage antiarmor/antipersonnel missile system.

BACKGROUND—CROSS REFERENCE TO RELATED APPLICATIONS

In my U.S. Pat. No. 3,421,410 (1969) for a missile and hand held launcher, the primary claim related to the benefits of a two stage missile system. In addition a closed breech hand held launcher was cited. Advantages of these aspects were in that the missile attained second stage ignition a predetermined safe distance from the operator, and the launcher was shoulder fired and resueable. A major disadvantage of this system was in that the severe recoil effects generated upon first stage ignition were directed to the operator without any reduction. A second disadvantage was that the basic missile configuration was excessive in size and weight. As larger caliber missiles were utilized, the subsequant increased recoil forces and difficulty in single person portability would prove prohibitive.

BACKGROUND—DESCRIPTION OF PRIOR ART

Heretofore, hand held antitank weapon systems were generally of the single stage open breech type, i.e. an initial firing launched the missile toward its intended target. The launcher or tube usually required a one man support and aim plus a second man for loading and guidance. Aiming of the launcher or tube was limited to a substantially flat trajectory in that the missile gravitationally rested within the tube in preparation for firing.

Once fired, the massive shock and blast to the rear created an extremely unsafe condition for personnel positioned behind the launcher. This blast also severely restricted the position of the operator in that the launch tube rear had to be directed away from all body parts. These effects limited the size of the firing charge in the missile and accordingly limited the distance that the missile could accurately travel to its target. As improvements in missile systems were realized, two stage rockets were utilized in anti-armor applications. The restrictions on the distance a missile could accurately travel, and to some degree, the restrictions on missile size were alleviated. The remaining disadvantages relating to extremely unsafe firing conditions, excessive shock, acoustic blast, and physical effects were still cause for concern. In addition these weapon systems continued to require a two person operation. The gravitationally seated position of the missile within the launch tube was still the prevalent form of missile situation.

Most weapon system's designed for use by infantry against armored vehicles, such as tanks were one shot in nature. Once fired, the entire system with the possible exception of guidance, was discarded. The complexity of these systems required the user to receive intensive and lengthy training.

In summation, these systems were costly in all phases of operation and lacked versatility. The ongoing advances in armored vehicle technology coupled with a growing need for multi-role ordinance mandates the need by infantry to be equipped with a more effective and efficient weapon.

OBJECTS AND ADVANTAGES

Accordingly, besides the objects and advantages of a two stage missile and closed breech system. The present invention employs a novel firing system that initially produces minor physical effects upon first stage ignition. These physical effects are further minimized through the incorporation of a pneumatic pressure system release and recoil pads. The first stage ignition propels the missile out of the closed breech launch tube. As missile exits the launch tube, the second stage ignition automatically occurs and missile is deployed to target. Further objects and advantages of the present system are:

(a) To provide a closed breech weapon system which can be quickly and safely used by infantry against heavily armored vehicles, tanks, bunkers, personnel.

(b) To provide a closed breech weapon system that by recognizable outward appearance and simplicity of design will be easily and rapidly comprehended by the average user.

(c) To provide a closed breech weapon system which secures the missile within the launch tube; so that the firing angle of said launch tube may be selectively varied without regard to accidental release of the missile.

(d) To provide a closed breech weapon system which can be aimed and fired using conventional line of sight techniques and or optics, ranging from telescopic to sophisticated guidance systems.

(e) To provide a closed breech weapon system capable of multiple and successive anti-armor antipersonnel applications.

(f) To provide a closed breech weapon system which through the utilization of composite fibre-resin materials is both lightweight and of sufficient strength to accommodate anti-tank-missiles.

(g) To provide a weapon system in which the recoil impulse and physical effects of missile ignition are minimized through the utilization of pneumatics, plenum chambers pressure purging ports and cushioned pads.

Still further objects and advantages are to provide a closed breech weapon system which can be easily operated by a single individual, either right or left handed which will accommodate existing antipersonnel munitions such as grenades and flechettes, which is durable in construction, which is simple to use and inexpensive to manufacture. Still further objects and advantages will become apparent from consideration of the ensuing descriptions and drawings.

REFERENCE NUMERALS IN DRAWINGS

Figure 1:
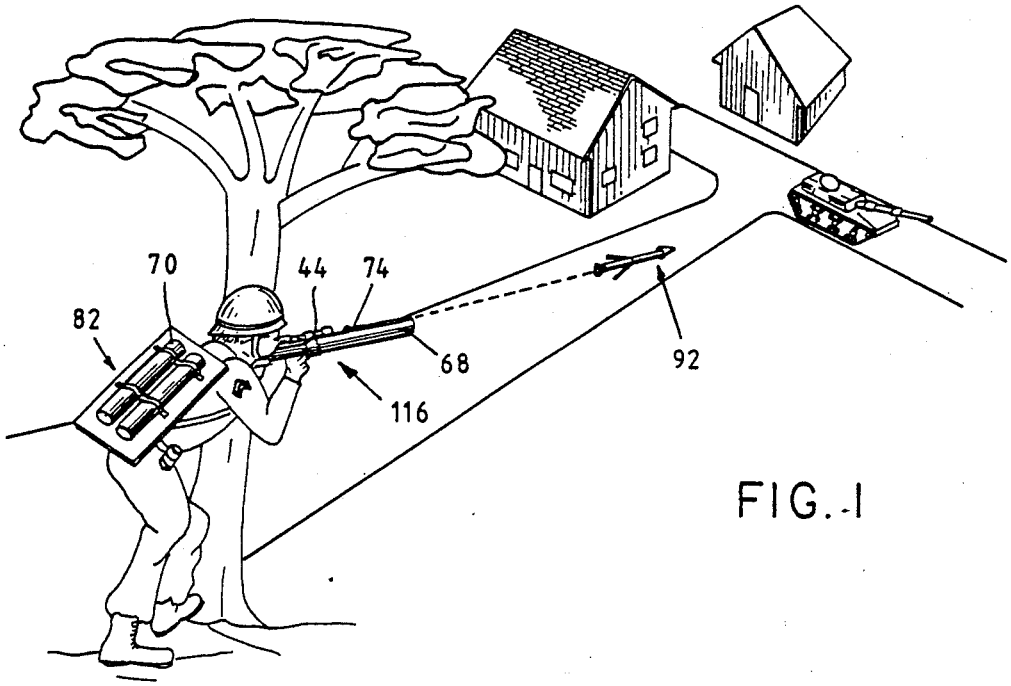
FIG. 1 Is a side view of the weapon system being aimed at a target.

20. launcher assembly
22. launcher main housing
24. trigger housing and grip
26. trigger mechanism
28. side to side blocking sear safety
30. reciprocating shoulder stock
32. recoil travel slots
34. recoil lock pins
36. secondary recoil pad
38. primary recoil pad
40. firing pin or electrical contact
42. optics perch
44. optics
46. main recoil bushing
48. main recoil bushing shaft
50. recoil shaft spring
52. pressure release port
54. compression bushing
56. compression bushing aperture
58. adjustable pressure release valve.
60. compression chamber
62. breech pins
64. replaceable main chamber breech
66. lockup slots
68. launch tube
70. launch tube end caps
72. loading and carrying handle
74. loading and carrying handle perch
76. locking collar
78. locking lugs
80. annular shoulder
82. preloaded launch tube
84. missile lock
86. base charge cylinder
88. rear seal and anti yaw unit
89. rear seal pressure purging ports
90. plenum chamber
92. missile
94. burster tube
96. 180° opposed venturi
98. thrust chamber
100. wall of thrust chamber
102. missile casing
104. fuel assisted spin stabilizers
106. stabilizer hinges
108. stabilizer thruster valves
110. second stage propellant
112. warhead
114. impact fuse
116. weapon system

DETAILED DESCRIPTION OF THE INVENTION

Figure 2:
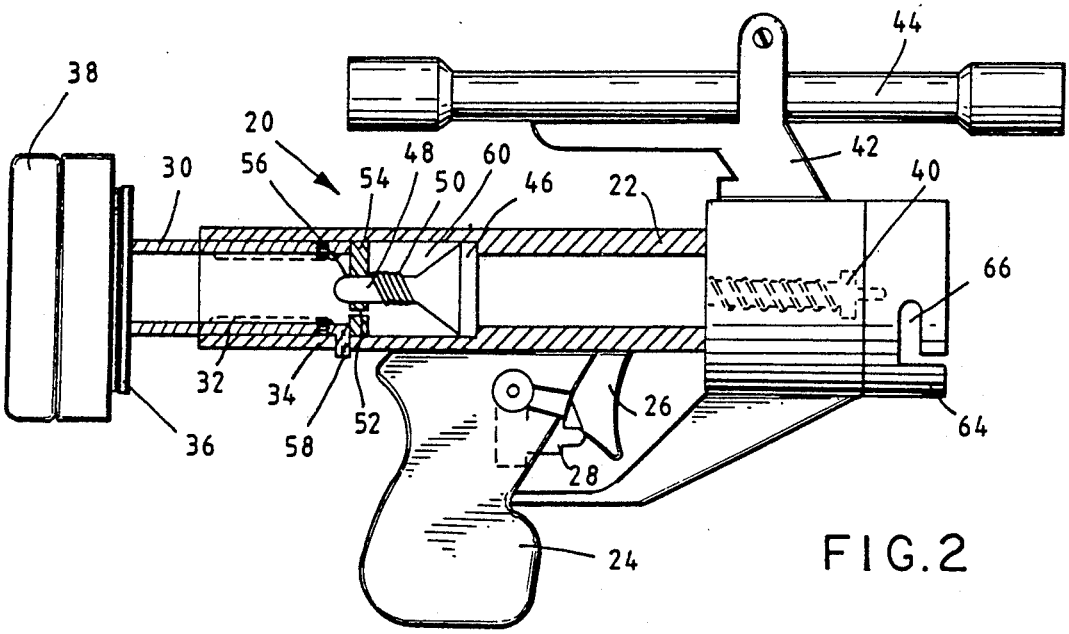
FIG. 2 Is a side view of the launcher assembly with a portion cut away to illustrate the configuration of the pneumatic recoil and position of firing pin or electrical contact.
Figure 3:
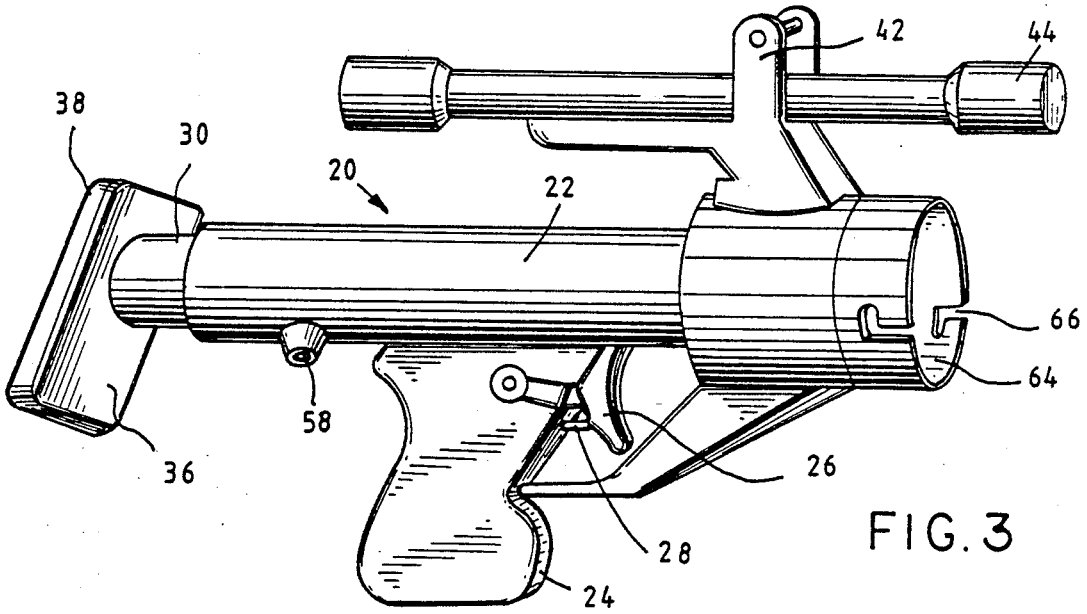
FIG. 3 Is a perspective view of the launcher assembly.
Figure 4:
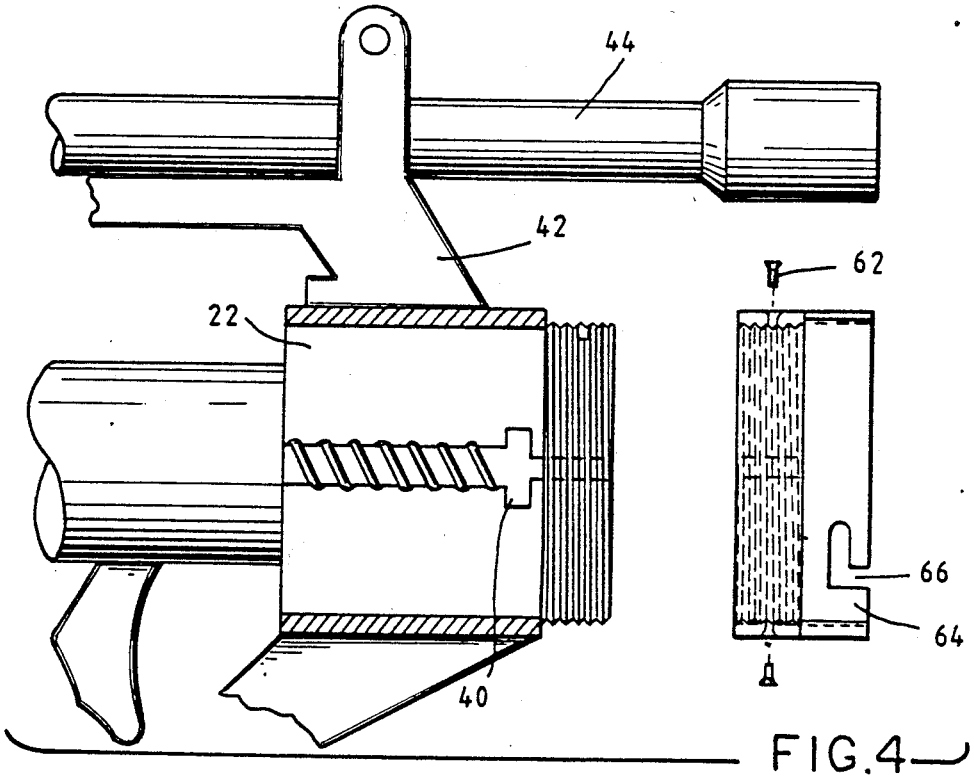
FIG. 4 Is a side view of replaceable main chamber breech assembly.

Referring to FIGS. 2, 3 and 4, the launcher assembly 20 comprises a reciprocating shoulder stock 30, which is affixed with a conventional primary recoil pad 38 and secondary recoil pad 36, said recoil pads being bolted and adhesively bonded to rear of said reciprocating shoulder stock.

Reciprocating shoulder stock 30 is held in operational position by the insertion of two diametrically opposed recoil lock pins 34 through the launcher main housing 22 and into the opposing recoil travel slots 32.

The compression bushing 54 is positioned at the rear end of the compression chamber 60, said compression bushing having substantially the same diameter as that of said compression chamber, and possessing a centrally located aperture 56, which is of sufficient diameter to permit the insertion of the main recoil bushing shaft 48. In addition, the compression bushing 54 is provided with a single pressure release port 52.

The main recoil bushing shaft 48, which is secured by means of threads and adhesive to the main recoil bushing 46, is fitted with a slide on recoil shaft spring 50, the diameter and static position of which seats the ends of said spring against the rear face of the main recoil bushing 46 and the forward face of the compression bushing 54. A shoulder stop formed by an enlarged internal wall section at the forward end of the compression chamber 60, physically prevents any forward movement of the, larger in diameter, main recoil bushing 46, within the launcher main housing 22.

An adjustable pressure release valve 58 is threadedly secured to the bottom rear of the launcher main housing 22.

A replaceable main chamber breech 64 with three 120° opposed lockup slots 66 is threadedly attached to launcher main housing 22 and secured with two diametrically opposed breech pins 62. Conventional firing pin or electrical contact 40 protrudes through the center of replaceable main chamber breech 64.

Trigger housing and grip 24, together with side to side blocking sear safety 28, trigger mechanism 26, firing pin or electrical contact 40, optics perch 42 and optics 44 are conventional in design and installation, they need not be described in detail. Such items are well known to those skilled in the art.

Figure 8:
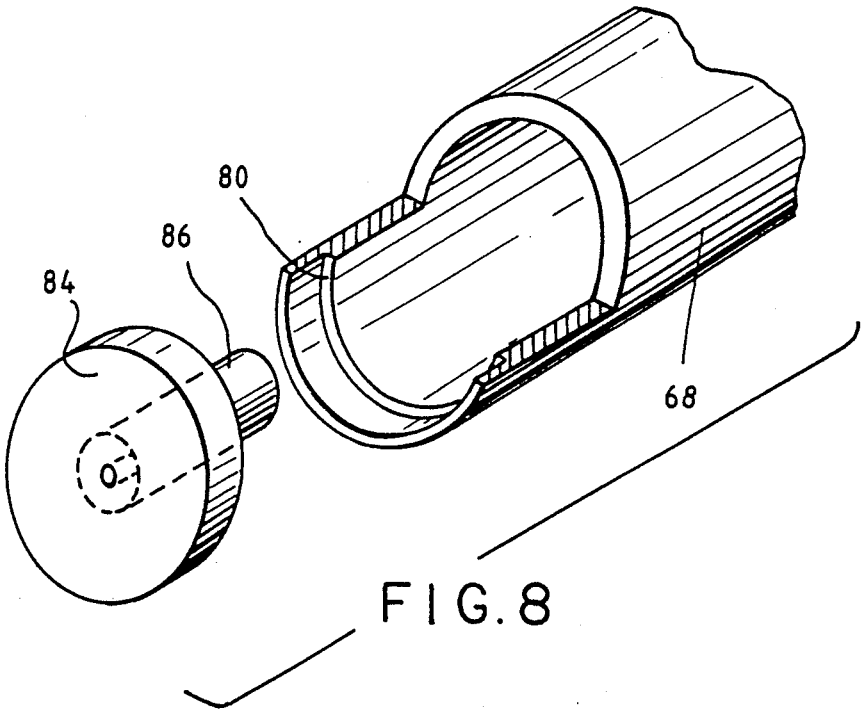
FIG. 8 Is a perspective view of the launch tube and missile taken from the side with a portion cut away to more fully disclose the locking means that secures the missile within the launch tube.
Figure 9:
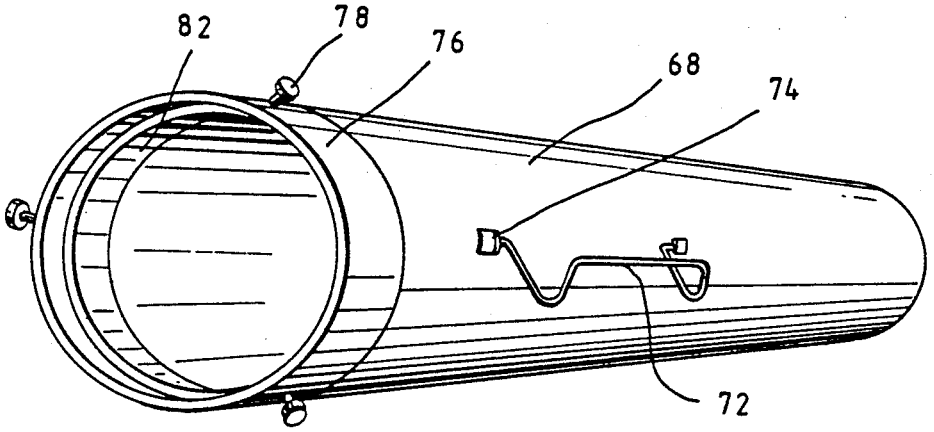
FIG. 9 Is a rear perspective view of launch tube locking collar and locking lugs.
Figure 10:
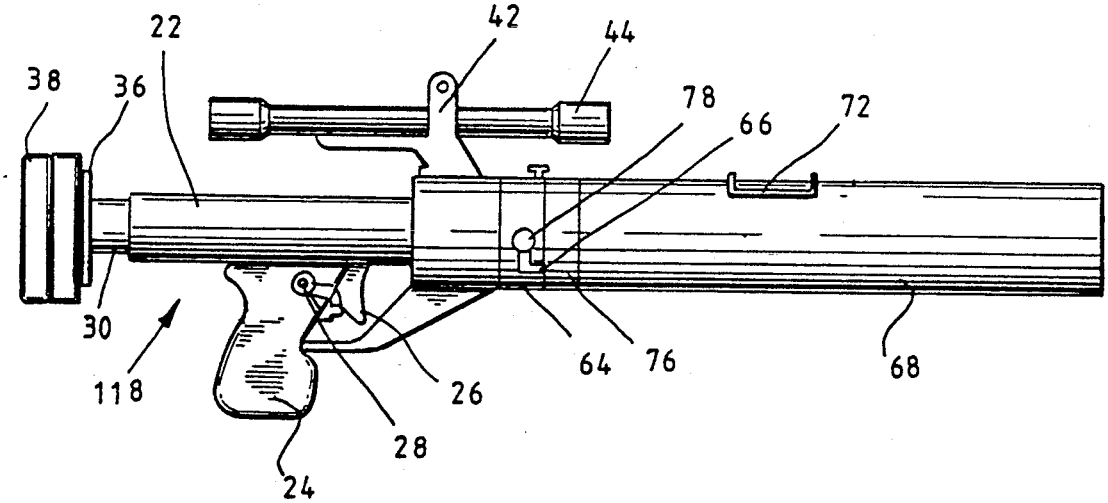
FIG. 10 Is a side view of the weapon system

Referring to FIGS. 8 and 9 of the drawings in detail, the launch tube 68 is shown as having a through bore, said launch tube is conventional and need not be shown in detail.

Such tubes are well known to those skilled in the art. It is sufficient to state that the launch tube 68 has a front orifice, through which a missile 92 or other projectiles will exit, as will be hereinafter described. Conversely, launch tube 68 has a rear orifice to which a locking collar 76 is attached, said collar being threaded and adhesively affixed to said launch tube rear. Locking collar 76 supports three integral locking lugs 78, which are each equally 120° opposed and which fit into lock up slots 66 on launcher assembly 20. A split section loading and carrying handle perch 74 which is adhesively bonded to launch tube 68 exterior, supports a loading and carrying handle 72, said handle ends being compressed and inserted through said handle perch apertures. Launch tube end caps 70 are press fit snapped over each end of pre-loaded launch tube assembly, FIG. 1 reference numeral 82.

Figure 5:
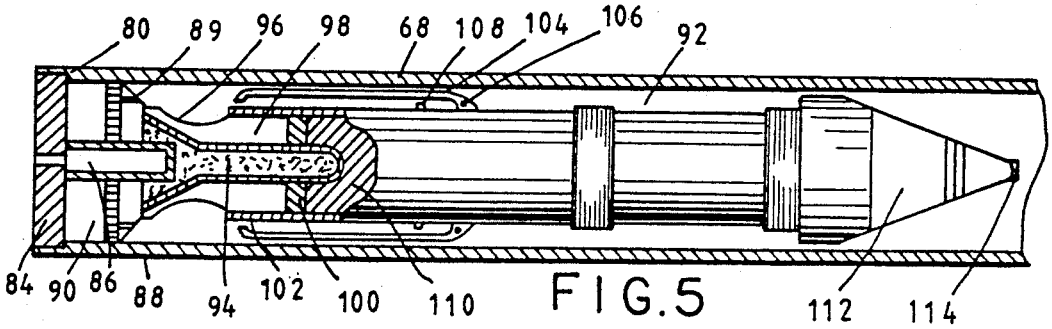
FIG. 5 Is a side view of the rocket type missile with a portion cut away to illustrate the first stage propellant.
Figure 6:
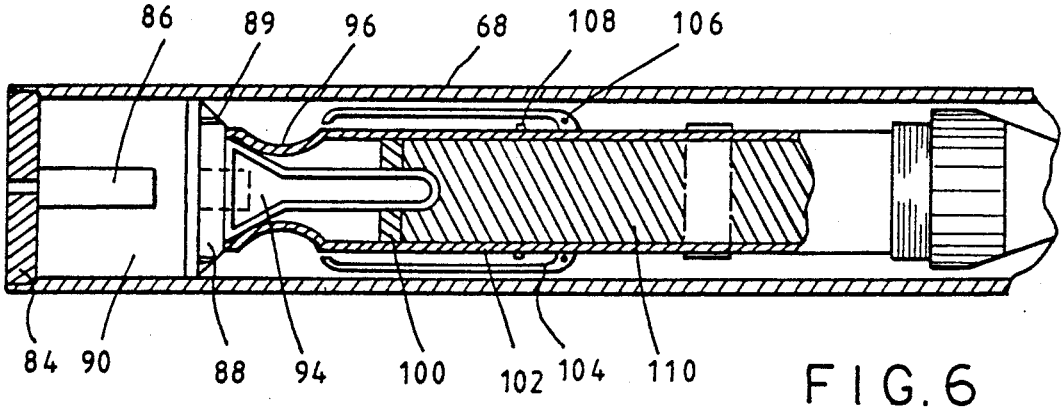
FIG. 6 Is an enlarged cross sectional detail of the missile and first stage in its fired position and prior to ignition of the second stage.
Figure 7:
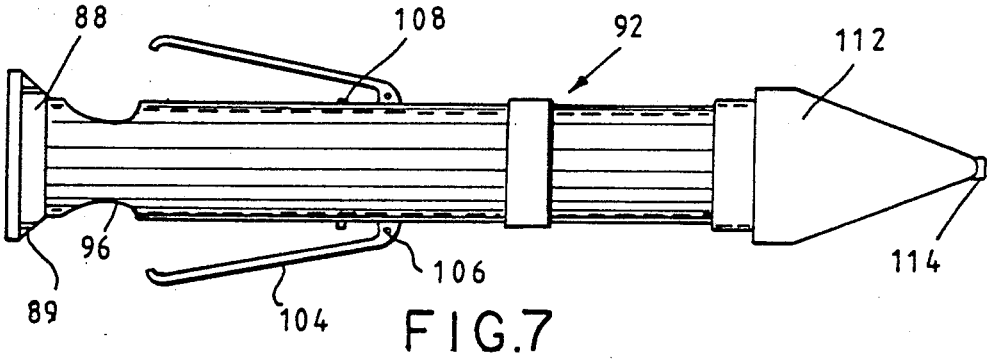
FIG. 7 Is a side view of the missile in its fired position and just after ignition of the second stage propellant charge.

Referring to FIGS. 5, 6 and 7 the missile 92 per se comprises an initial firing section, a missile lock 84 containing a centrally located primer charge and a base charge cylinder 86 which are threadedly joined, said missile lock and base charge being press interference fitted through the centrally located aperture in the rear seal and anti yaw unit 88 forming a plenum chamber 90 and in direct contact with the rear of burster tube 94. The missile lock 84 is positioned within an enlarged internal diametrical portion of the launch tube 68, said enlarged diametrical portion forming an annular shoulder 80 which effectively prevents said missile lock from forward movement, thereby securing missile 92 in the desired position within said launch tube.

The rear seal and anti yaw unit 88 is substantially the same diameter as that of the internal diametrical portion of the launch tube 68 and is welded to the missile casing 102. Two diametrically opposed rear seal pressure purging ports 89 are machined onto the periphery of the rear seal and anti yaw unit 88. A centrally located aperture within the rear seal and anti yaw unit 88 allows the base charge cylinder 86 to insert and make direct contact with the rear of the burster tube 94. Burster tube 94 is attached by threads to internal wall of missile casing 102 at extreme rear and extends through the wall of thrust chamber 100 and into the second stage propellant 110.

Fuel assisted spin stabilizers 104 are attached to missile casing 102 using welded stabilizer hinges 106, they are additionally positioned directly over stabilizer thruster valves 108, which are threaded into missile casing 102.

Warhead 112 and impact fuse 114 are conventional and well known to those skilled in the art, and need not be described in detail.

OPERATION OF INVENTION FIGS. 1 THROUGH 9

This weapon system (FIG. 1) 116 is a hand held, shoulder fired launcher assembly (FIGS. 2 and 3) 20. It is loaded via launch tube assembly (FIG. 1) 82 which contains a missile (FIG. 5) 90. Missile 90 is prevented from unwanted movement within launch tube (FIG. 8) 68 by the seating of the missile lock 84 against an annular shoulder 80 which is machined into said launch tube. Prior to loading of launch tube assembly (FIG. 1) 82, launch tube end caps 70 are removed and discarded, in an emergency only the breech end cap must be removed. Launch tube assembly 82 containing missile (FIG. 5) 90 is locked and loaded by grasping the loading and carrying handle (FIG. 8) 72, then aligning and engaging the three locking lugs (FIG. 9) 78, which are equally spaced about the locking collar 76, to the corresponding lock up slots (FIG. 4) 66, which are machined into the replaceable main chamber breech 64, rotating said launch tube assembly counter clockwise approximately 20° until a lock up of weapon system (FIG. 1) 116 is completed. Weapon system 116 is then conventionally shouldered and is in firing mode as with other conventionally shouldered firearms such as a rifle or shotgun.

Engagement of trigger mechanism (FIG. 2) 26 activates a conventional firing pin or electrical contact 40 thereby igniting primer and base charge cylinder (FIGS. 5,6 and 7) 86 and attaining first stage ignition. Base charge cylinder 86 immediately ignites burster tube 94 which contains fuze, said fuze is timed to reach and ignite a second stage propellant 110, upon exit from launch tube 68, said propellant being a conventional solid or liquid type. Upon first stage ignition missile 92 separates from missile lock 84 and base charge cylinder 86 and exits launch tube (FIG. 8) 68. Rear seal and anti yaw unit (FIGS. 5,6) 88 serves to confine the majority of escaping gases from primary ignition within launch tube (FIG. 8) 68 until missile 92 has exited said launch tube, additionally, said rear seal serves to provide level stabilization or anti-yaw of missile 92 within said launch tube. The recoil effects generated upon first stage ignition are reduced and minimized by first the incorporation of a plenum chamber 90 in which is dissipated a large part of the recoil forces. Further recoil reductions are accomplished by the incorporation of two rear seal pressure relief ports 89. A pneumatic type pressure release system as contained within the launcher main housing (FIGS. 2,3) 22 the operation of which is as follows: Recoil effects still remaining, after plenum chamber 90 reduction, drive the launcher main housing 22 rearward on to reciprocating shoulder stock 30 thereby driving main recoil bushing 46 towards compression bushing 54. Air which is present in the compression chamber 60 is then forced through pressure release port 52 and finally through an adjustable pressure release valve 58. The remainder of the recoil effects are then additionally reduced by the utilization of conventional recoil pads 38 and 36 which are affixed to the reciprocating shoulder stock 30. Once the recoil effects have spent themselves, the recoil shaft spring 50 completes the pneumatic cycle and separates the main recoil bushing 46 from the compression bushing 54 thereby moving the launcher main housing 22 forward and ready for an additional firing. Second stage ignition occurs almost immediately upon missile (FIG. 7) 92 exit from launch tube (FIG. 8) 68. Fuel assisted spin stabilizers 104 are deployed by the force of the escaping gasses directed upon them from the stabilizer thruster valves 108. Intense thrust and propellant gasses are primarily deflected from the users path to rear utilizing two diametrically opposed exhaust venturi, said venturi being angled outward at a 60° angle and secondly deflected by the rear seal and anti yaw unit 88 located directly behind said exhaust venturi. The wall of thrust chamber 100 being exposed to the ignited second stage propellant 110 burns away providing the thrust required to propel the missile to its intended target.

Upon completion of missile 92 deployment, launch tube (FIG. 9) 68 is unlocked and rotated clockwise 20° out of lock up slots (FIG. 2,3 and 4) 66 on launcher assembly 20 then discarded.

Missile lock 84 and spent base charge cylinder 86 are also discarded. Launcher assembly 20 is now ready for acceptance of a following loaded launch tube assembly (FIG. 1) 82

SUMMARY, RAMIFICATIONS AND SCOPE

Accordingly, the reader will see that the closed breech missile and weapon system of this invention can be used in a variety of anti-armor/antipersonnel scenarios. In addition, this weapon system requires such a minimal amount of time for training and familiarization that its value is inherently enhanced. Furthermore, the closed breach design offers additional advantages in that:

It permits virtually any variation of firing angle thereby encompassing the scope of anti-armor, antipersonnel and antiaircraft weapon systems.

It provides the user with a weapon system which, through a familiar appearance, visually appears simple and safe to use.

It allows a single infantry person the much desired ability to administer repeated firings from either a defensive or offensive posture, at heavily armored vehicles such as tanks.

It provides for a very rapid change in ordinance from anti-armor to antipersonnel by merely selecting any variation of preloaded launch tubes where ever appropriate.

It permits the use of various size projectiles and types of warheads through dimensional changes in the launch tube and missile lock units.

It provides a cost effective system in that the basic shoulder fired launcher is durable, reusable and light enough to be carried in addition to other weapons-/equipment.

What is claimed is:

1. A closed breech missile and weapon system, particularly lightweight, for anti-armor/anti-personnel use, comprising:

(a) a preloaded launch tube, a launcher assembly, recoil reducing means, connecting means for attaching and detaching weapon components, wherein the entire physical structure of the assembled weapon system is positioned against and to the front of the operators shoulder when in firing mode;

(b) a missile fired from a shoulder backed hand held launcher and launch tube;

(c) a first stage ignition system, that propels the missile a safe predetermined distance from the launch tube;

(d) a second stage fusing means that ignites second stage propellant when said missile has traveled the predetermined distance from the launch tube; and (e) a locking means to secure the missile in the launch tube, formed through the combined utilization of a missile lock, annular shoulder and press interference fit, permitting said launch tube to be aimed in any desired trajectory, 2. A closed breech missile and weapon system as claimed in claim 1, wherein recoil 15 reduced through the incorporation of apparatus comprising:

(a) a plenum chamber means including rear seal pressure relief ports wherein the full pressure arising from primary missile ignition is instantly reduced thereby reducing recoil effects and maintaining weapons stability in a line of sight targeting often; and (b) a shoulder stopped reusable pneumatic pressure release system containing primary and secondary recoil pads, wherein reduced recoil effects, from primary missile ignition are further minimized.

3. A closed breech missile and weapon system as claimed in 1, further comprising:

(a) a weapon system attaching and detaching means having a single right or left handed operator; and (b) a preloaded and sealed launch tube wherein a locking collar forms the exterior wall of a plenum chamber when fully engaged with the closed breech launcher.

* * * * *